US005611231A

United States Patent [19]

Marritt et al.

[11] Patent Number: 5,611,231

[45] Date of Patent: Mar. 18, 1997

[54] MODULAR BASE CAN PROCESSING EQUIPMENT

[76] Inventors: Clifford R. Marritt, 328 Beechcliff Ct., Winston-Salem, N.C. 27104; Harold J. Marshall, 217 Valleywood Dr., Forest, Va. 24551; Terry Babbitt, 109 Oakmont Ct., Lynchburg, Va. 24503

[21] Appl. No.: 426,122

[22] Filed: Apr. 20, 1995

[51] Int. Cl.[6] ..... B21D 37/02

[52] U.S. Cl. ..... 72/94; 72/455; 198/583

[58] Field of Search ..... 72/94, 352, 356, 72/379.4, 404, 455; 198/575, 583, 608

[56] References Cited

U.S. PATENT DOCUMENTS 2,467,278 4/1949 Thompson ..... 198/608

2,550,156 4/1951 Lyon ..... 198/583

4,519,232 5/1985 Traczyk et al. ..... 72/133

*Primary Examiner*—Lowell A. Larson

[57] ABSTRACT

An apparatus for performing reshaping operations on a can, with the apparatus being modular in construction. The modular construction allows for the easy add-on of additional processing stations for performing additional reshaping operations to the cans. Each module is readily connected to an adjacent module in such spaced relationship that cans are transferred directly from can support pockets that hold the cans during processing on one module to can support pockets that hold the cans during processing on the adjacent module, without the need for any conveyors or track work to transfer the cans. The modules are cast with internal chambers that form vacuum chambers, gear chambers, and/or pressurized air passageways. The internal chambers of one module can be interconnected with corresponding internal chambers in adjacent modules.

18 Claims, 9 Drawing Sheets

MODULAR BASE CAN PROCESSING EQUIPMENT

BACKGROUND OF THE INVENTION

1. Field of the Invention

The present invention relates to machines for reshaping cylindrical metal bodies. More specifically, the invention relates to a modular base constructed from a plurality of prefabricated modules which provide support for rotatable turret assemblies having a plurality of can reshaping tools mounted thereon. The modular base is constructed such that the modules can be connected to each other in side-by-side relationship, with different modules supporting turret assemblies that carry the same or different can reshaping tools and with the turret assemblies being supported in close proximity to each other such that cans that have been processed by the tools on one turret assembly are moved directly to another turret assembly for further processing without the need for any conveyor or track work to carry the cans from one processing station to the next.

2. Related Art

Apparatus provided heretofore for processing cylindrical metal cans have required conveyors or track work for carrying cans that have been subjected to a first reshaping operation at a first processing station to another station for the performance of a second reshaping operation. The use of track work or conveyors in existing apparatus for carrying cans from one processing station to another often results in physical damage to the cans as well as a loss of control of any particular can throughout the series of processing operations performed on the can.

In a manufacturing facility using existing can processing equipment, there is no simple and efficient way to simply add on a desired number of additional workstations to the existing equipment in order to provide for a desired number of additional processing steps. This limitation reduces the flexibility of existing manufacturing facilities to adapt to new requirements imposed by the end users of the cans. For example, as various industries demand cans made from increasingly thinner metal in order to save on raw material costs, necking operations performed on the cans must be completed over a greatly increased number of die necking processing steps. The increase in the number of processing steps results from the need to deform the thin metal making up the can a small amount at a time. These die necking operations are performed at successive turrets carrying die necking tooling of increasingly smaller diameter. Necking of cans having thin metal walls is achieved with the greatest degree of success when the open end of the cans is deformed gradually in a series of small steps.

With existing apparatus, if it is desired to add additional turrets in order to accommodate the successive die necking operations, conveyors or track work must be provided to convey the cans from the existing turrets to the newly added turrets. An inherent disadvantage of such a set-up is that precise control of the position of a can at any particular time is lost while the can is being shuttled along the conveyor. An additional disadvantage of existing can processing apparatus is the likelihood of damage to the cans while they are being conveyed from one processing station to the next.

SUMMARY OF THE INVENTION

It is therefore an object of the present invention to provide for a novel and improved apparatus for performing reshaping operations on a can wherein the apparatus is modular in construction in order to allow for the easy add-on of additional processing stations without any loss of control of the can throughout the entire process.

It is another object of the present invention to accept and utilize existing shaft assemblies within a modular base to provide for future extensions of additional modules. Complete control of each can is maintained throughout the entire processing operation as each can is passed between processing stations. It is a further object of the present invention to eliminate the necessity for any conveyors or track work for transporting the cans from one processing station to another. It is a further object of the present invention to eliminate damage to cans resulting from moving cans between processing stations along conveyors.

The apparatus of the present invention provides a modular base for supporting can processing equipment wherein the modular base includes a plurality of modules with each module having a headstock support portion and a tailstock support portion for rotatably supporting a spindle drive shaft and at least one transfer drive shaft. The headstock support portion supports the first end of each of the drive shafts and driving or driven means for each of said shafts. The headstock support portion is subdivided into several internal chambers including an upper gearbox portion, which provides clearance and support for the first end of each of the drive shafts, and further includes a gear chamber that houses a drive gear mounted to the first end of the spindle drive shaft and a driven gear mounted to the first end of the transfer drive shaft. In addition to the gear chamber, the upper gearbox portion includes at least one connecting vacuum chamber. The connecting vacuum chamber communicates vacuum from a main vacuum chamber formed below the gearbox portion to the first end of a drive shaft which can be provided with radial and axial passageways to further transfer the vacuum to a point of application. The vacuum can be used to aid in the handling of cans when it is provided to can support pockets or can transfer pockets mounted on the drive shaft. The headstock support portion further includes pressurized air passageways, which provide pressurized air to assist in moving cans into and out of position for processing. The pressurized air also provides internal support of the cans during the processing.

The modular base further includes a tailstock support portion, which supports a second end of the spindle drive shaft, and which is subdivided into a mounting portion and a connecting portion, and wherein said headstock support portion and said tailstock support portion have axially spaced, transverse interfacing portions with a common pattern of bolt holes and/or alignment studs for interconnection of the headstock support portion and the tailstock support portion. The transfer drive shafts are supported only by the headstock support portion at the first end of each of the transfer drive shafts. The modular base can be constructed from a single casting/fabrication, or as multiple castings/fabrications—as dictated by manufacturing methodology.

The modular base of the present invention further includes side interface portions on the sides of each headstock support portion, wherein said side interface portions have patterns of bolt holes and/or studs together with a key and keyway for enabling alignment and connection of adjacent modules. The modules of the present invention are each provided with at least two drive shafts. One of these drive shafts is the spindle drive shaft and carries thereon tools for reshaping the cans, as well as can support pockets for holding the cans in position for processing. Another of the drive shafts is the transfer drive shaft mounted parallel to the spindle drive shaft, (or at a 45 degree angle to the spindle drive shaft in the case of a right angle drive module) and carries can transfer pockets for moving cans to and from the can support pockets on the spindle drive shaft.

The main vacuum chambers provided in each of the headstock support portions of the modular base can be maintained in communication with each other. Alternatively, the vacuum chambers provided in each of the headstock support portions can be sealed from communication with each other through the use of a seal plate that is provided between adjacent modules, thereby closing off the vacuum chambers in both modules. The pressurized air passageways provided in the headstock support portion of each module can also be maintained in communication with each other, thereby eliminating the need for separate pressurized air lines running to each processing station to provide air during the processing of the cans. The gear chambers provided in the headstock support portion of each module can also be maintained in communication with each other, thereby eliminating the need for a separately extendable gear case.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
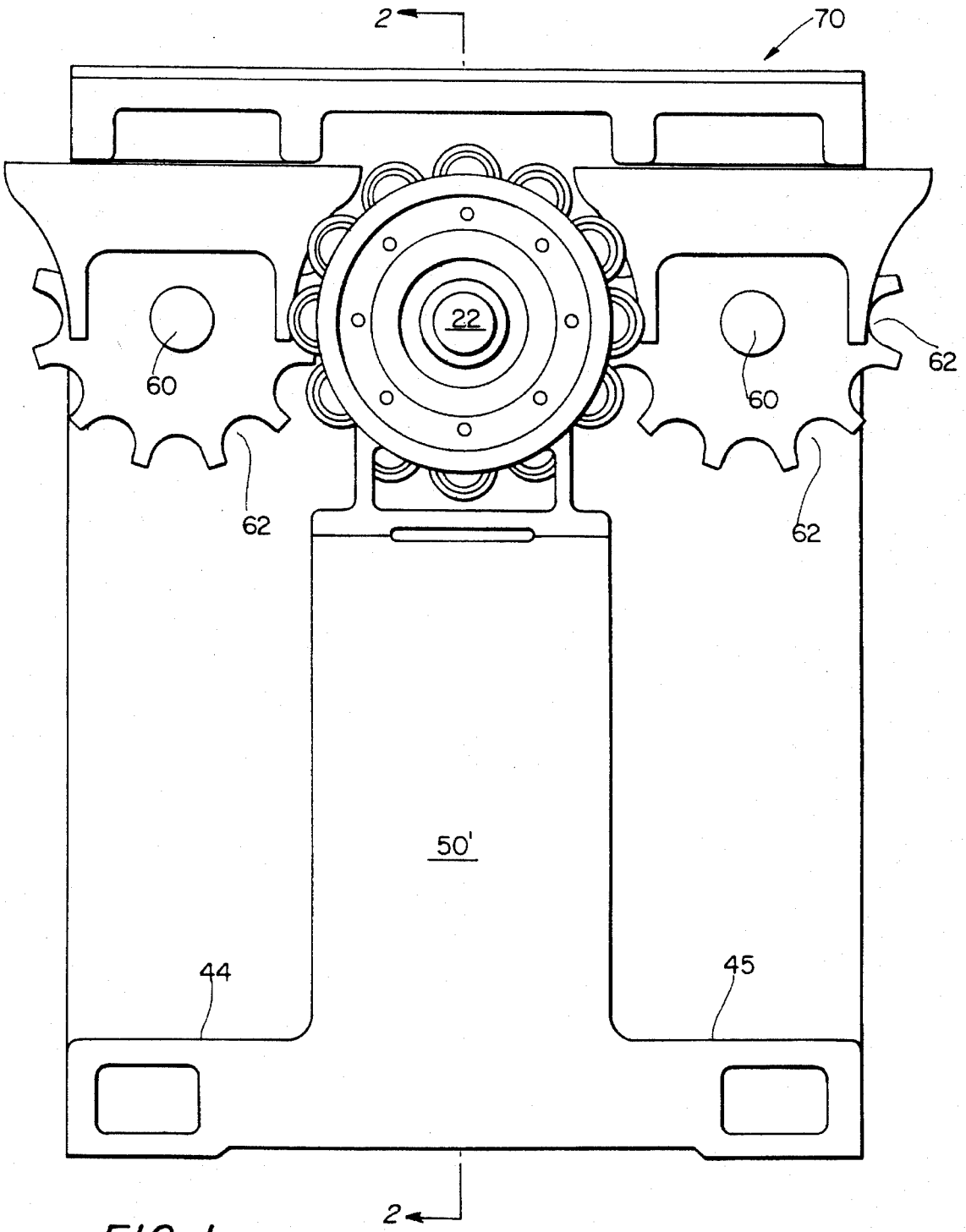
FIG. 1 is an end elevation view of a driver module according to the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
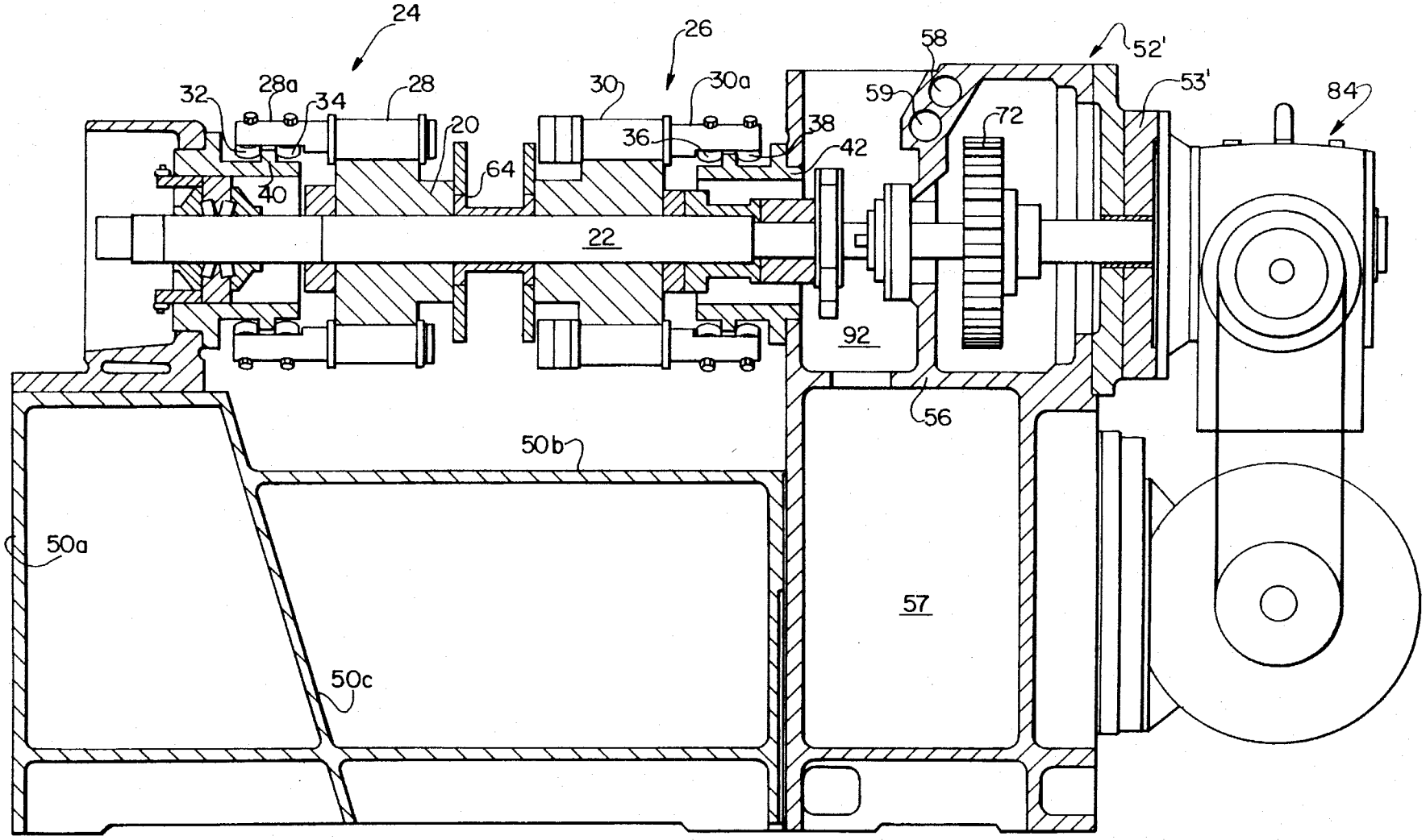
FIG. 2 is an axial sectional elevation view of the apparatus shown in FIG. 1 taken in the direction of arrows 2—2 of FIG. 1.

The general arrangement and structure of a can processing machine including the modular base of the present invention is best understood from FIG. 2. More specifically, a turret 20 is mounted on a spindle drive shaft 22 for rotation therewith in well known manner. A number of pairs of opposite, axially aligned spindle ram assemblies 24 and 26 are mounted on turret 20 at equally spaced intervals around the outer circumference of turret 20. Ram assemblies 24 and 26 each include a ram housing 28 and 30 respectively, rigidly fixed to turret 20, and a ram assembly **28*a* and 30*a* respectively, that is free to move axially within a respective ram housing 28 or 30. In certain applications, ram assembly 28*a* and/or ram assembly 30*a*** may be provided with a coaxial, rotatably mounted tooling shaft that is free to rotate and may provide means for mounting can reshaping tools such as rollers for reforming the can bottom. Examples of such applications are shown in copending U.S. patent application Ser. Nos. 08/189,241, 08/189,243 and 08/268,812, which are herein incorporated by reference.

One end of ram assembly **28*a* includes a pair of cam rollers 32 and 34. Similarly, one end of ram assembly 30*a* includes a pair of cam rollers 36 and 38. First and second stationary cam members 40 and 42 are respectively provided at opposite ends of the apparatus facing opposite axial ends of turret 20 with cam 40 having axially opposite contoured cam surfaces that engage with rollers 32 and 34; and cam 42 having axially opposite contoured cam surfaces that engage with cam rollers 36 and 38. Cam members 40 and 42 are rigidly connected to a tailstock support portion (such as 50' in FIG. 4) of the modular base of the present invention, and a headstock support portion (such as 52' in FIG. 4**) of the modular base of the present invention, respectively.

Spindle drive shaft 22 is rotatably mounted on tailstock support portion 50' and headstock support portion 52' of the driver module component 70 of the modular base of the present invention, as shown in FIG. 2. Similarly, an identical spindle drive shaft 22 is rotatably mounted on tailstock support portion 50" and headstock support portion 52" of a right hand drive module 82 (shown in FIG. 3D and FIG. 5), and on tailstock support portion 50" and headstock support portion 52" of a left hand drive module 80 (shown in FIG. 3B and FIG. 6).

Figure 3D:
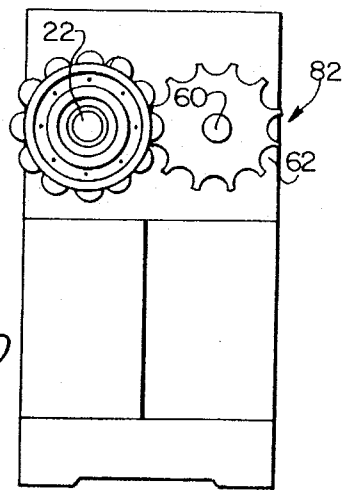
FIG. 3D is an end elevation view of a right-hand module according to the present invention.
Figure 3C:
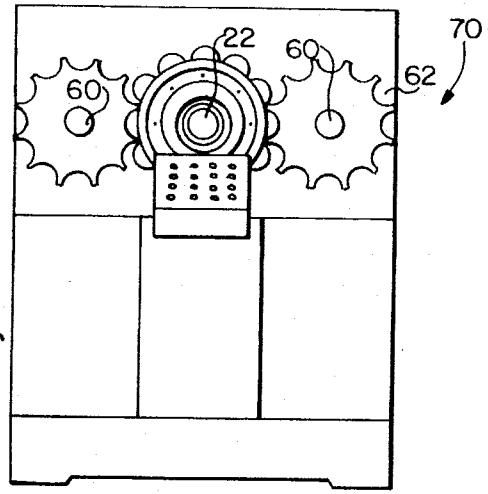
FIG. 3C is an end elevation view of a driver module according to the present invention.
Figure 3B:
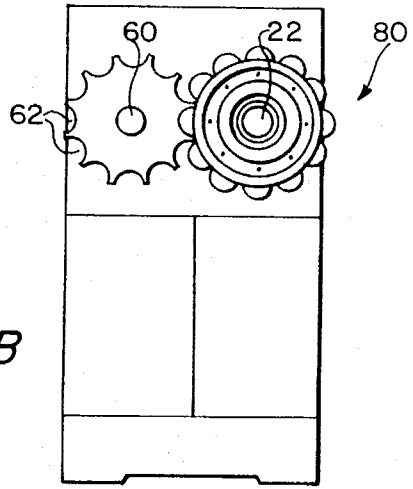
FIG. 3B is an end elevation view of a left-hand module according to the present invention.
Figure 3A:
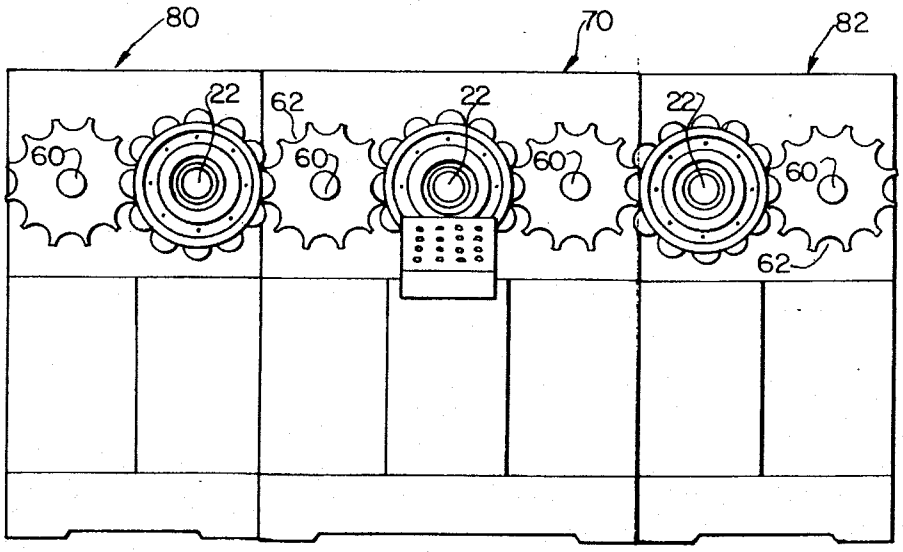
FIG. 3A is an end elevation view of a portion of a can processing apparatus assembled from modules according to the present invention, and including a left-hand module, a driver module, and a right-hand module.

Driver module 70 is generally the central module in a series of modules making up the modular base according to the present invention, as shown in FIG. 3A. The modules positioned to the right of driver module 70, as viewed from the axial end of each module facing the tailstock support portion, are right hand modules 82. The modules positioned to the left of driver module 70, as viewed from the axial end of each module facing the tailstock support portion, are left hand modules 80.

Figure 4:
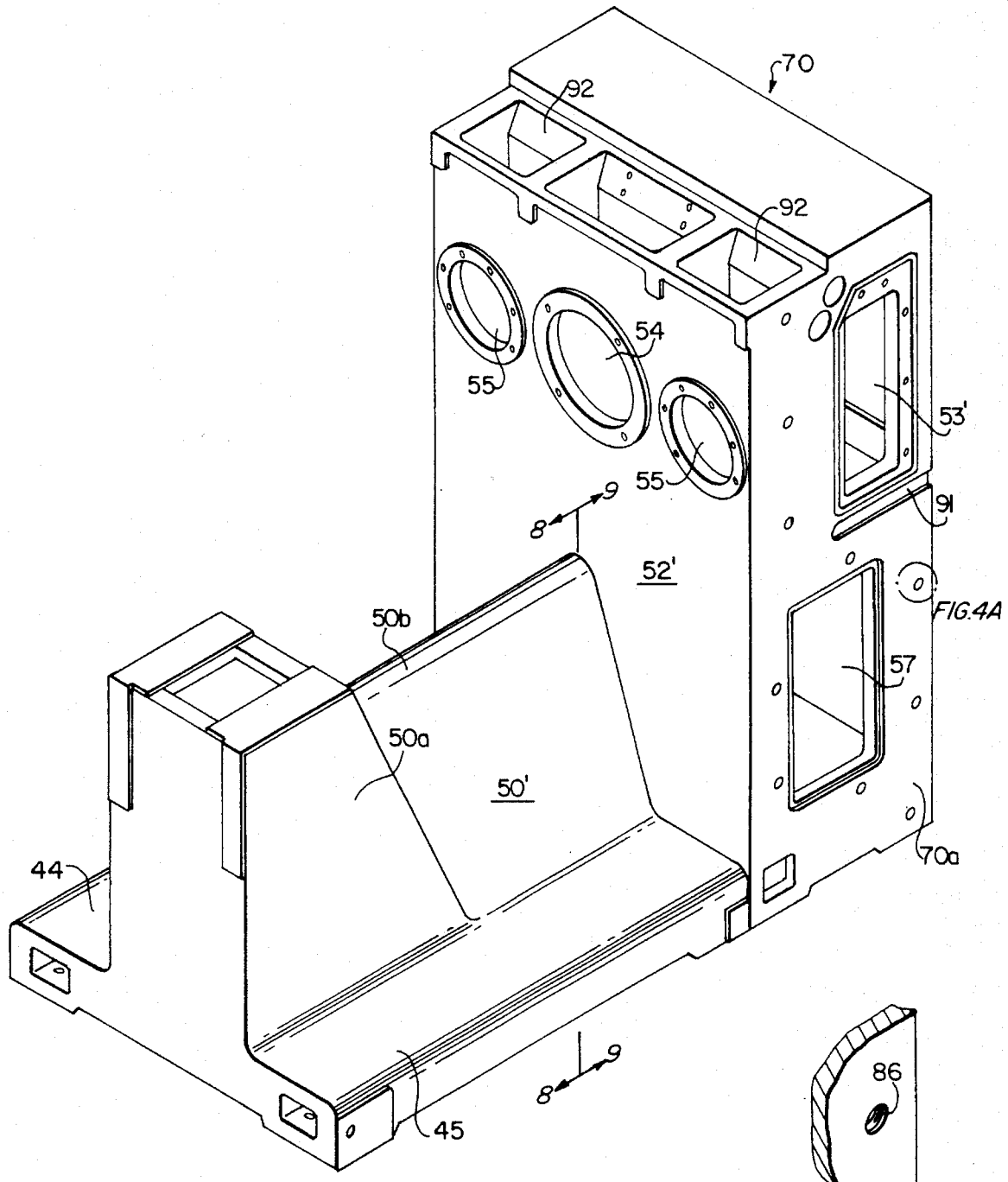
FIG. 4 is a perspective view of a driver module according to the present invention, including a headstock support portion connected to a tailstock support portion.
Figure 4A:
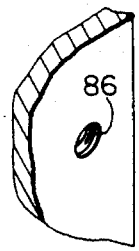
FIG. 4A is an enlarged view of a portion of a side interface surface on the headstock support portion of the driver module, showing a threaded attachment hole.
Figure 8:
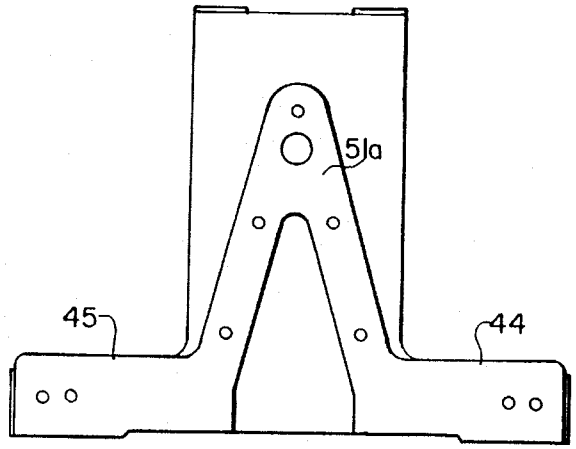
FIG. 8 is a transverse sectional view, taken in the direction of arrows 8—8 in FIG. 4.
Figure 9:
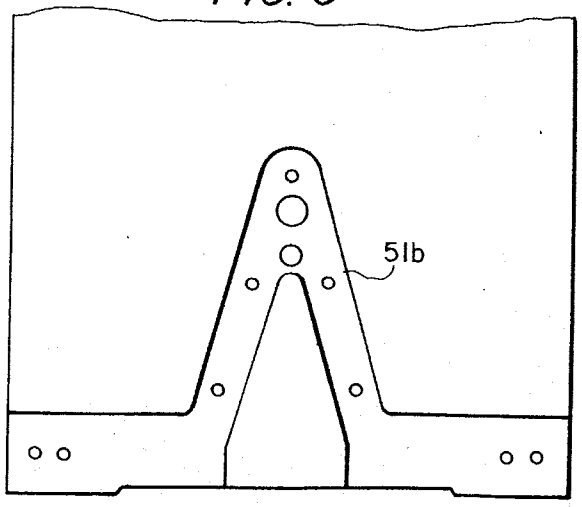
FIG. 9 is a transverse sectional view, taken in the direction of arrows 9—9 in FIG. 4.

Tailstock support portion 50' of driver module 70 includes laterally extending leg portions 44 and 45 that provide a firm support base, as best shown in FIG. 4. A tailstock mounting portion 50*a* extends vertically at one axial end of tailstock support portion 50' and provides rotary support for one axial end of the spindle drive shaft 22, and fixed support for cam member 40. A tailstock connecting portion 50*b*, having a substantially triangular cross section, extends axially from mounting portion 50*a* and terminates in a transverse interface portion 51*a*. Transverse interface portion 51*a* mates with corresponding, axially spaced, transverse interface portion 51*b* on headstock support portion 52' through a pattern of bolt holes and/or dowel pin holes, as best seen in FIGS. 8 and 9. The axial end of spindle drive shaft 22 opposite from the end supported on tailstock mounting portion 50*a* passes through a locating hole 54 on headstock support portion 52' and is rotatably mounted by bearings or bushings supported by headstock support portion 52'. Locating holes 55 through headstock support portion 52' on laterally opposite sides of locating hole 54 provide location and support for cantilevered transfer drive shafts 60 (shown in FIG. 3A) supported by headstock support portion 52'. Cantilevered transfer drive shafts 60 carry can transfer pockets 62 that transfer cans to and from can support pockets 64 mounted on spindle drive shaft 22.

Figures 5, 5A:
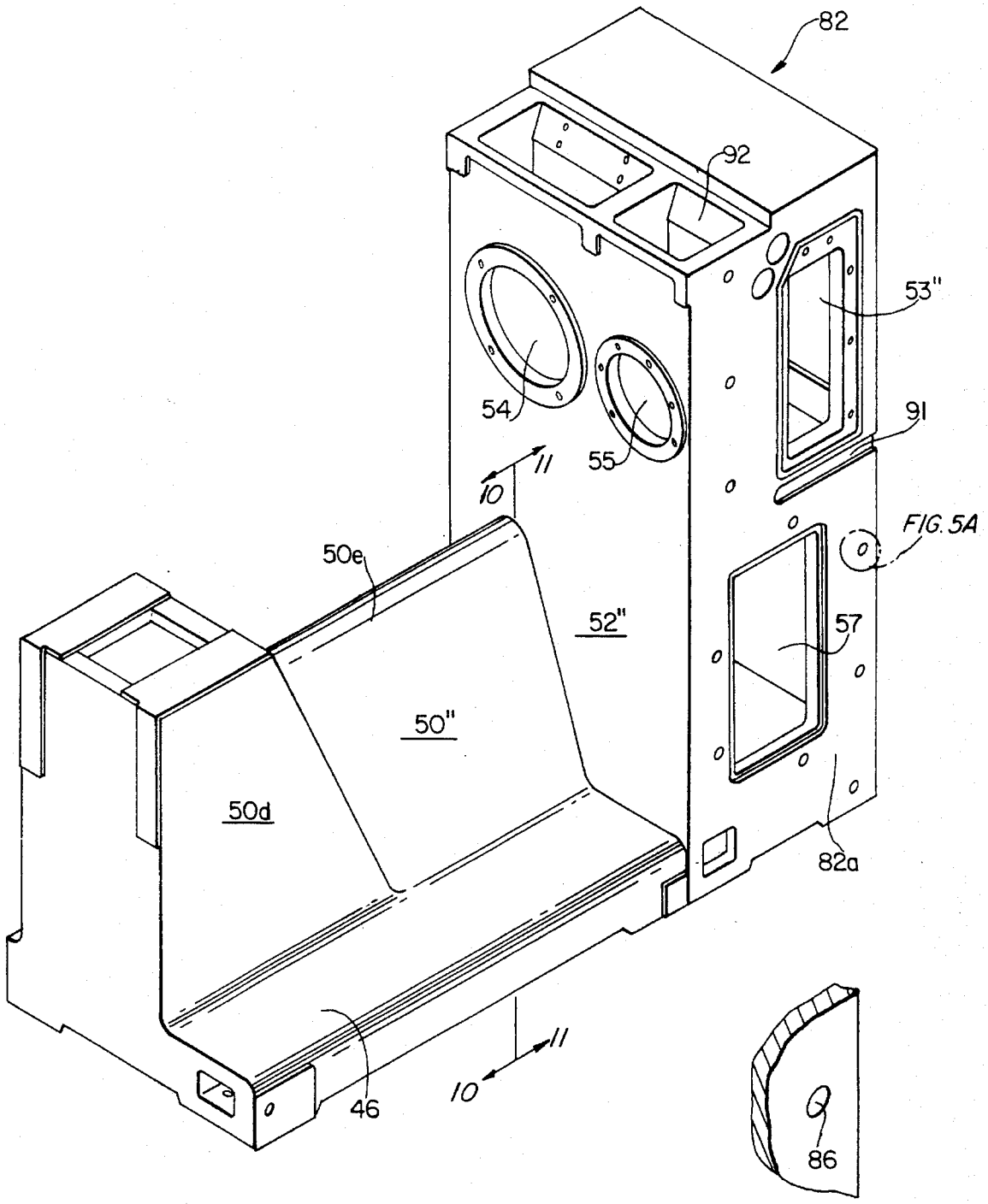
FIG. 5 is a perspective view of a right-hand module according to the present invention, including a headstock support portion connected to a tailstock support portion.
FIG. 5A is an enlarged view of a portion of a side interface surface on the headstock support portion of the right-hand module of FIG. 5 showing a threaded attachment hole.
Figure 6:
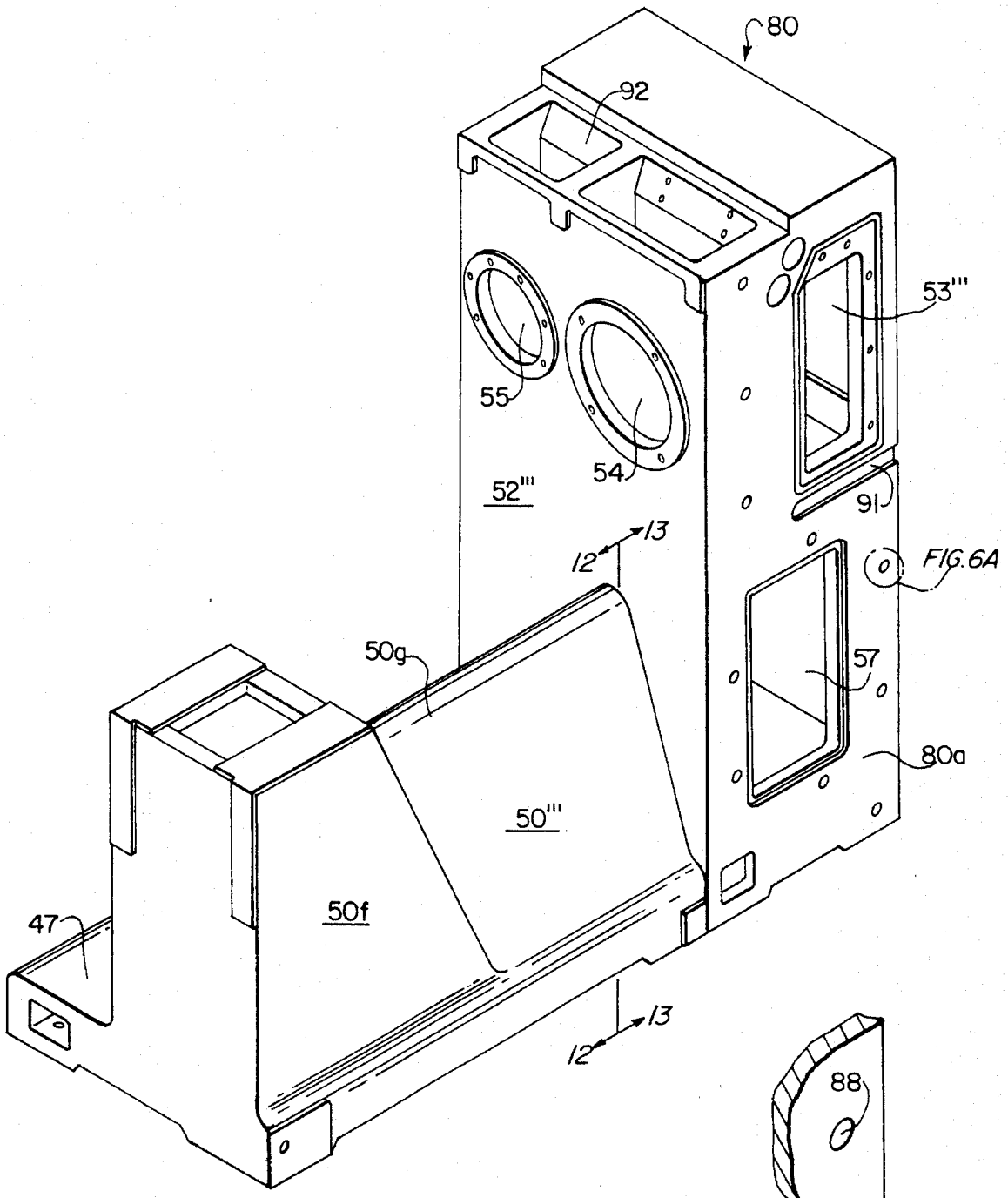
FIG. 6 is a perspective view of a left-hand module according to the present invention, including a headstock support portion connected to a tailstock support portion.
Figure 6A:
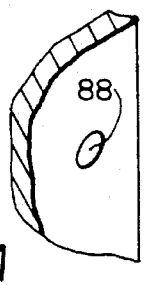
FIG. 6A is an enlarged view of a portion of a side interface surface on the headstock support portion of the left-hand module shown in FIG. 6 showing a smooth bore attachment hole.

Right hand module 82, shown in FIG. 5, is similar to driver module 70, except that tailstock support portion 50" has only one laterally extending leg 46 on one side of spindle drive shaft 22, and only one locating hole 55 in headstock support portion 52" for a cantilevered transfer drive shaft 60. Left hand module 80, shown in FIG. 6, is essentially a mirror image of right hand module 82, with laterally extending leg 47 of tailstock support portion 50'" and locating hole 55 in headstock support portion 52" being on the opposite side of spindle drive shaft 22 from that of right hand module 82.

In addition to a spindle drive shaft 22 being supported by the headstock support portion and tailstock support portion of each module, at least one substantially parallel cantilevered transfer drive shaft 60 is rotatably mounted on the headstock support portion of each module, as best shown in FIG. 3A. A driver module 70, as best shown in FIG. 1, includes two such transfer drive shafts 60, one mounted on each side of spindle drive shaft 22. Each transfer drive shaft 60 supports a plurality of circumferentially spaced can transfer pockets 62, in an arrangement commonly referred to as a "star wheel", such as shown in copending U.S. patent application No. 08/189,241, which is herein incorporated by reference. Can transfer pockets 62 are rigidly connected to transfer drive shaft 60, and rotate therewith as transfer drive shaft 60 is rotated by a driven gear (not shown) that engages with driver gear 72 mounted on a first end of spindle drive shaft 22.

Spindle drive shaft 22 and turret 20 of each module are also connected to a plurality of circumferentially spaced can support pockets 64 which are positioned so as to support cans for processing in between axially aligned ram housings 28 and 30. Individual can support pockets 64 can be bolted to turret 20, such as shown in copending U.S. patent application entitled "Improved Can Feed And Work Station" filed on Mar. 8, 1995 under attorney docket number 18493.047 (serial no. not yet assigned), which is herein incorporated by reference.

Can transfer pockets 62 mounted on transfer drive shaft 60 and can support pockets 64 mounted on spindle drive shaft 22 are positioned relative to each other such that as spindle drive shaft 22 and transfer drive shaft 60 are rotated, cans are transferred directly from can support pockets 64 on spindle drive shaft 22 to can transfer pockets 62 on transfer drive shaft 60. Driver module 70 includes spindle drive shaft 22 and two transfer drive shafts 60, one on each side of spindle drive shaft 22. A motor 84, or other means for rotating spindle drive shaft 22, is mounted on the headstock support portion 52' of driver module 70. Left-hand module 80 has only one transfer drive shaft 60 mounted on the left side of spindle drive shaft 22, as viewed from the axial end of spindle drive shaft 22 that is supported by tailstock mounting portion 50*f* of tailstock support portion 50'", as shown in FIG. 3B and FIG. 6. Right-hand module 82, as shown in FIG. 3D and FIG. 5, has only one transfer drive shaft 60 mounted on the right-hand side of spindle drive shaft 22 as viewed from the axial end of spindle drive shaft 22 that is supported by tailstock mounting portion 50*d* of tailstock support portion 50".

Left-hand module 80, right-hand module 82, and driver module 70 are each provided with side interface surfaces 80*a*, 82*a*, and 70*a*, respectively, such that the individual modules can be readily connected in side-by-side relationship. Side interface surfaces 70*a*, 80*a*, and 82*a*, are each provided with a pattern of bolt holes 86 and a key/keyway 91, as shown in FIGS. 4, 4A, 5 and 5A, for alignment and interconnection of the modules.

Figure 7:
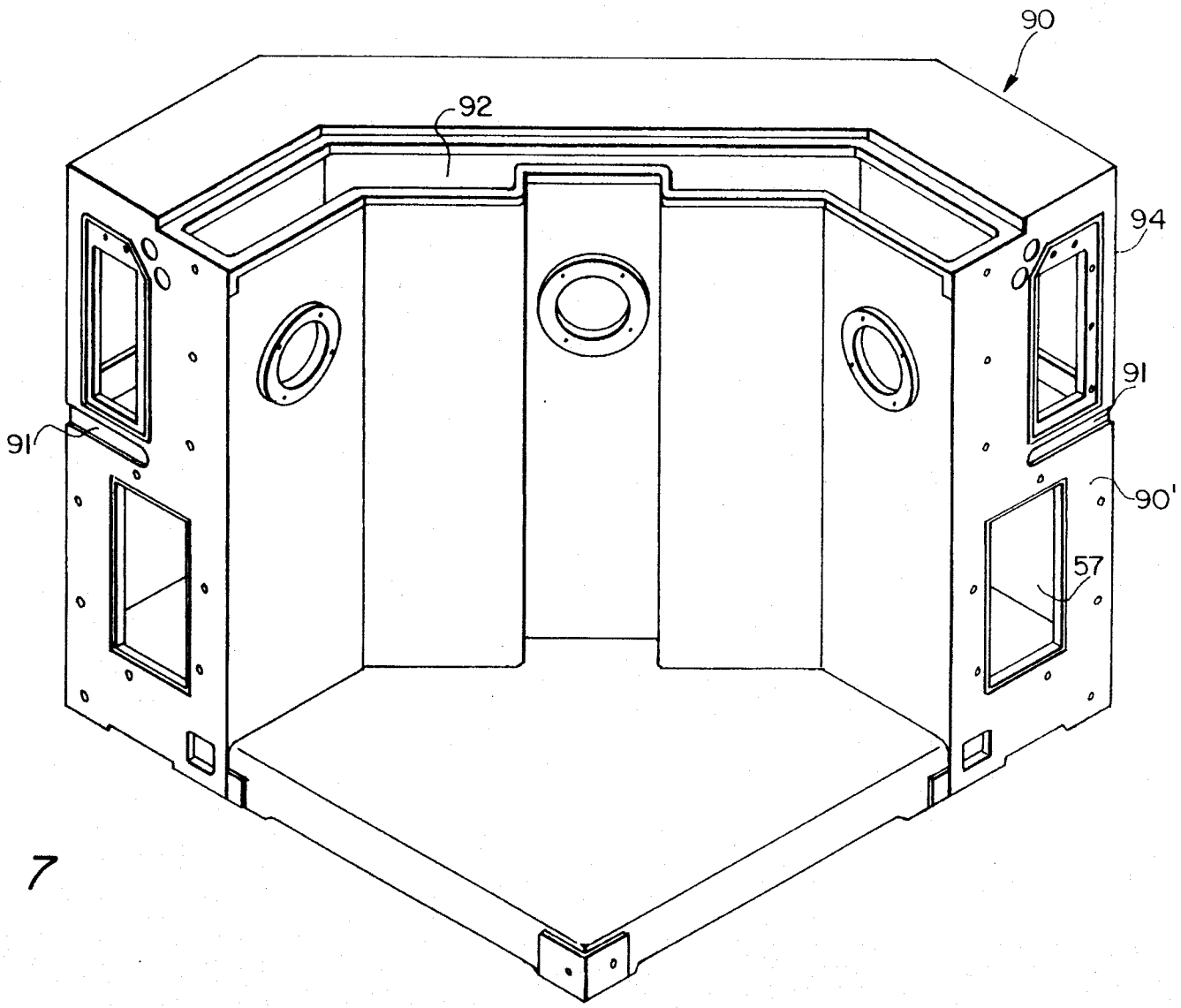
FIG. 7 is a perspective view of a right angle drive module according to the present invention.

When a series of modules are connected, as shown in FIG. 3A, spindle drive shaft 22 and can support pockets 64 of each module are spaced from transfer drive shaft 60 and can transfer pockets 62 of an adjacent module such that when spindle drive shaft 22 of one module is rotated and transfer drive shaft 60 of an adjacent module is rotated, a can is transferred directly from can support pockets 64 on spindle drive shaft 22 of the one module to can transfer pockets 62 on transfer drive shaft 60 of the adjacent module. If additional processing stations are desired on an existing modular can processing apparatus, additional left-hand modules 80, right-hand modules 82, driver modules 70, or right-angle transfer modules 90 (as shown in FIG. 7), can be easily connected at their respective side interface surfaces to the existing modular can processing equipment. Right angle transfer modules 90 allow for the transfer of cans around corners, thereby providing flexibility in processing machine layout and conservation of existing floor space in the manufacturing facility.

Figure 7A:
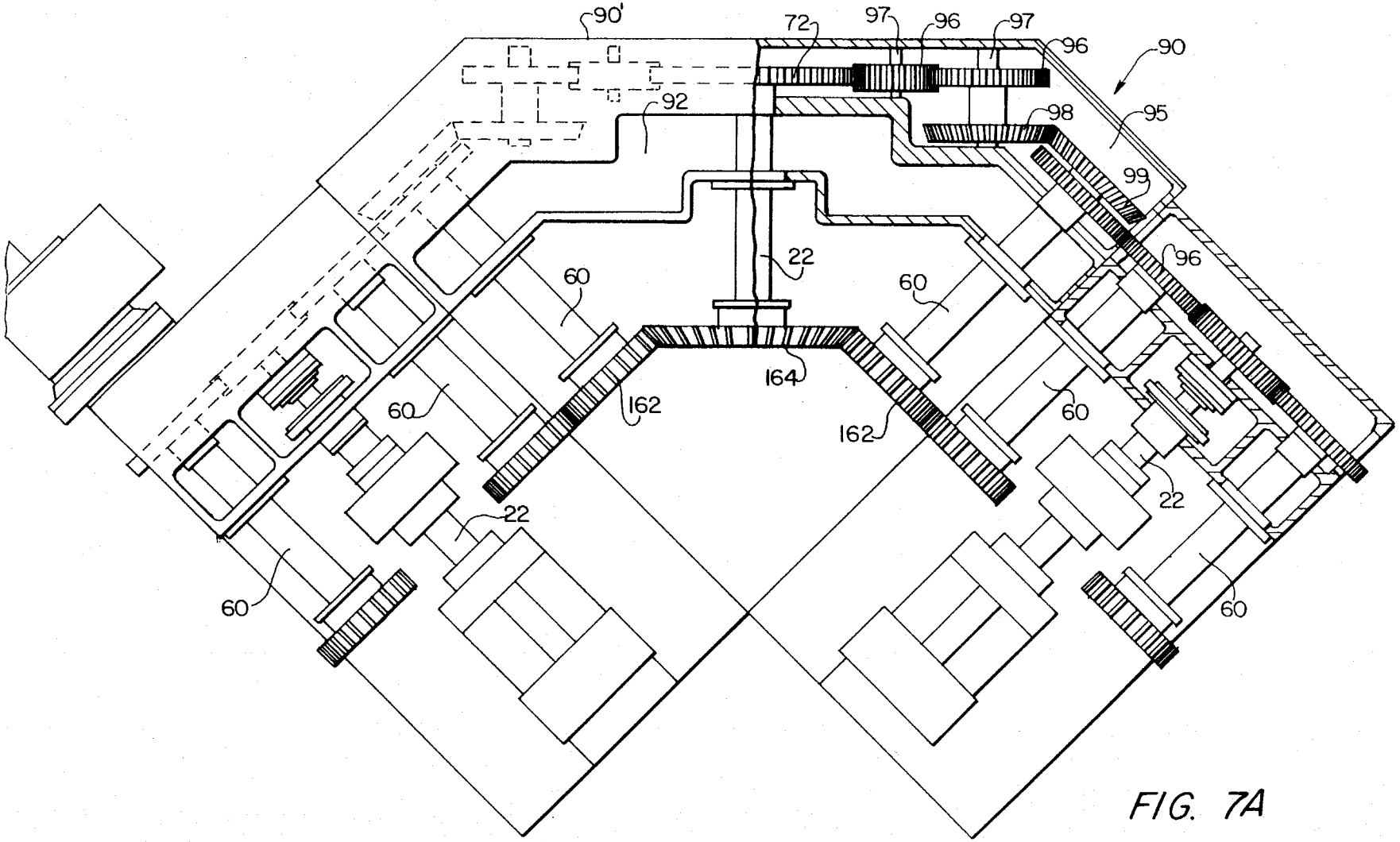
FIG. 7A is a plan view in partial cross section, showing the right angle drive module of FIG. 7 connected to two additional modules.
Figure 12:
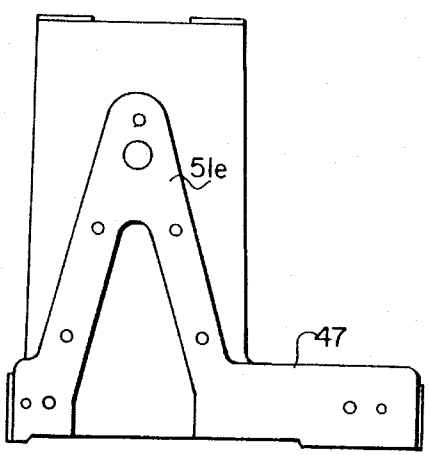
FIG. 12 is a transverse sectional view, taken in the direction of arrows 12—12 in FIG. 6.
Figure 13:
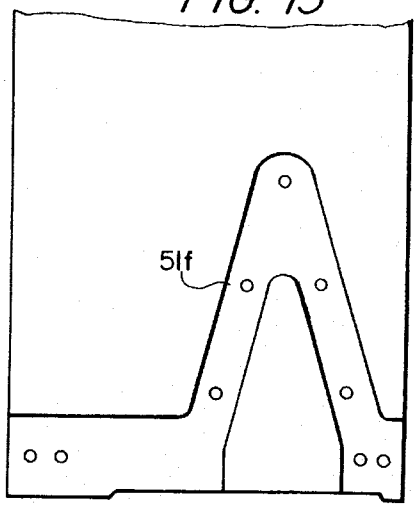
FIG. 13 is a transverse sectional view, taken in the direction of arrows 13—13 in FIG. 6.
Figure 10:
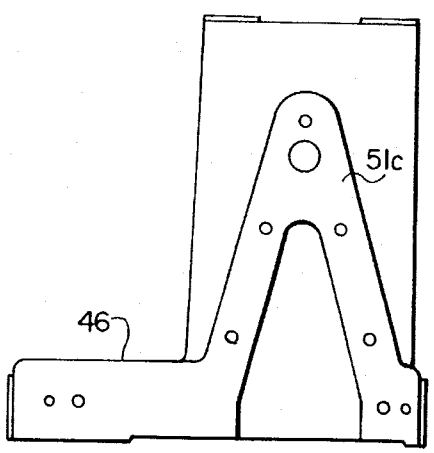
FIG. 10 is a transverse sectional view, taken in the direction of arrows 10—10 in FIG. 5.
Figure 11:
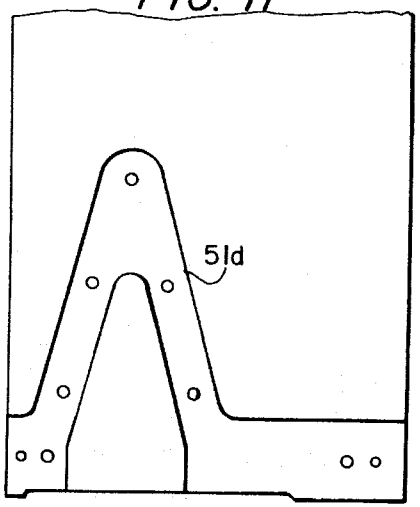
FIG. 11 is a transverse sectional view, taken in the direction of arrows 11—11 in FIG. 5.

Right angle transfer module 90, as shown in FIG. 7A, includes an upper gearbox portion 94 that is subdivided into a continuous gear chamber 95, and a connecting vacuum chamber 92. Right angle transfer module 90 is further subdivided into a continuous vacuum chamber 57 that allows for the transfer of vacuum to connecting vacuum chamber 92, and then through radial and axial passageways through spindle drive shaft 22 and/or transfer drive shafts 60 to points of application. Gear chamber 95 located in upper gearbox portion 94 houses a plurality of gears 96 mounted on parallel shafts 97 extending across gear chamber 95 in spaced relationship such that gears 96 are meshingly engaged in series. The outer parallel shafts 97 mounted at both sides of module 90 support bevel gears 98 mounted in tandem with gears 96. Bevel gears 98 engage with additional bevel gears 99 mounted on cantilevered ends of transfer drive shafts 60 that extend into gear chamber 95 at opposite sides of module 90. A spindle drive shaft 22 is connected to a driver gear 72 that forms the central gear in the series of gears 96. Driver gear 72 can be connected to a driving means such as an electric motor if it is desired to use right angle transfer module 90 as a driver module. Transfer drive shafts 60 supported at both sides of right angle transfer module 90 are oriented at approximately 45 degrees to spindle drive shaft 22 supported at the center of right angle transfer module 90. Special beveled can support pockets 164 are mounted on the end of spindle drive shaft 22 opposite from driver gear 72; and can transfer pockets 162 are mounted on the ends of transfer drive shafts 60 opposite from bevel gears 99. Beveled can support pockets 164 are designed and located so as to be able to pass cans directly to can transfer pockets 162, effecting a 45 degree change in orientation of the central axes of the cans. The right angle transfer module with can transfer pockets 162 mounted on opposite sides of special beveled can support pockets 164 therefore results in a 90 degree change in orientation of the central axis of cans that are handled by the right angle transfer module 90.

Each module 70, 80, 82 and 90, is preferably constructed from a ductile cast iron. Modules 70, 80 and 82 each consist of a substantially rectangular headstock support portion 52', 52" or 52'" and a tailstock support portion 50', 50" or 50'". Right angle transfer module 90 includes a headstock support portion 90', shown in FIG. 7, having side portions that are at an angle relative to a central, rectangular portion, such that the side portions support transfer drive shafts 60 at an angle relative to central spindle drive shaft 22 supported by the central rectangular portion. Headstock support portions 52', 52", 52'" and 90' each have an upper gearbox portion 53', 53", 53'" or 94, respectively, forming a continuous gear chamber when a plurality of modules are connected together in side-by-side relationship, and having axial through-holes 54 and 55 which provide clearance and/or location surfaces for rotatably supporting spindle drive shaft 22 and transfer drive shafts 60, respectively. Headstock support portions 52', 52", 52" and 94 are each subdivided into internal chambers separated by internal walls 56. A vacuum chamber 57 is formed in the headstock support portion below the upper gearbox portion. Connecting vacuum chambers 92 provide an interconnection between main vacuum chambers 57 and spindle drive shaft 22 and/or transfer drive shaft 60.

Vacuum chamber 57 is connected through openings through internal walls 56, connecting vacuum chambers 92, and axial and radial passageways through spindle drive shaft 22 or transfer drive shaft 60 to openings in can support pockets 64 or can transfer pockets 62, respectively, when vacuum is desired to help hold cans in place on can support pockets 64 during processing or on can transfer pockets 62 during transfer. Additionally, a high pressure air passageway 58, and a low pressure air passageway 59 can be provided through internal walls 56 in the upper gearbox portion of a respective headstock support portion. Air passageways 58 and 59 provide pressurized air for can processing, and eliminate the need for separate air lines running to each can processing station.

When adjacent modules are interconnected at their side interface surfaces, gaskets can be provided around vacuum chambers 57 and air passageways 58 and 59 in order to ensure a leak-tight fit. When it is desired to provide vacuum to only one module, a seal plate can be provided over the ends of vacuum chamber 57 in that one module, thereby confining the vacuum created by a vacuum pump (not shown) to that single module. If vacuum is desired in a number of adjacent modules, the seal plate is eliminated and open gaskets are provided between the vacuum chambers 57 in adjacent modules.

In addition to providing the bearing support surfaces for rotatably mounting spindle drive shafts 22 and transfer drive shafts 60, upper gearbox portions 53', 53", 53'" and 94 of headstock support portions 52', 52", 52'" and 90', respectively, also provide clearance for driver gears 72 and driven gears (such as 96 in right angle transfer module 90) which are fixed at one axial end of each spindle drive shaft 22 and transfer drive shaft 60. When adjacent modules are interconnected at their respective side interface surfaces, the driver gears and driven gears of adjacent modules are engaged such that, for example, rotation of the spindle drive shaft 22 of driver module 70, having driver gear 72 and motor 84 mounted thereon, is transferred in series to successive transfer drive shafts and spindle drive shafts mounted in adjacent modules extending to the left and to the right of a center driver module 70. Direct engagement between gears that are rigidly attached to spindle drive shafts 22 and transfer drive shafts 60 is enabled by the open communication between gear chambers in the upper gearbox portions of adjacent modules. This direct engagement ensures that rotation of can support pockets 64 will always be in synch with rotation of can transfer pockets 62.

The end of spindle drive shafts 22 and transfer drive shafts 60 opposite from the driving or driven ends of each of said shafts is supported on a tailstock support portion 50', 50" or 50'", as best shown in FIG. 2. Tailstock support portion 50', of driver module 70, is subdivided into a mounting portion **50*a* and a connecting portion 50*b*, as shown in FIG. 4. Tailstock support portion 50', of right hand module 82, is subdivided into a mounting portion 50*d* and a connecting portion 50*e*, as shown in FIG. 5. Tailstock support portion 50'" of left hand module 80, is subdivided into a mounting portion 50*f* and a connecting portion 50*g*, as shown in FIG. 6**.

Tailstock connecting portions **50*b*, of driver module 70, 50*e* of right hand module 82 and 50*g* of left hand module 80 are substantially triangular in cross-section and extend axially from mounting portions 50*a*, 50*d* and 50*f*, respectively, to a transverse interfacing portion 51*a*, 51*c* or 51*e*, respectively, that connects to headstock support portion 52', 52" or 52'", respectively. Mating surface 51*b* of headstock support portion 52', mating surface 51*d* of headstock support portion 52", mating surface 51*f* of headstock support portion 52'" and corresponding axially spaced transverse interfacing portions 51*a*, 51*c* and 51*e* on respective tailstock support portions, are ground fiat as shown in FIGS. 8–13**, and are provided with the pattern of bolt holes and dowel pin holes as shown.

The angled internal wall **50*c* between the mounting portion of a tailstock support portion and a tailstock connecting portion is provided for additional strength and ease of manufacture of the tailstock support portion. Angled internal walls 50*c*, in cooperation with the triangular cross section of tailstock connecting portions 50*b*, 50*e* and 50*g***, serve to direct rejected or displaced processed product to a place of easy collection and out of the way of any rotating machine parts.

Modifications and variations of the above-described embodiments of the present invention are possible, as appreciated by those skilled in the art in light of the above teachings. For example, the shape of the tailstock support portions and the headstock support portions can be varied as long as there is consistency in size for any particular line of modules, and the modules are sized such that the spindle drive shafts and transfer drive shafts of adjacent modules will be supported at the correct lateral distance from each other for direct transfer of cans being processed.

It is therefore to be understood that, within the scope of the appended claims and their equivalents, the invention may be practiced otherwise than as specifically described.

What is claimed is:

1. A modular base for supporting can processing equipment wherein said modular base includes a plurality of modules with each module having:

a headstock support portion, said headstock support portion supporting a first end of a drive shaft and driving means for driving said drive shaft, and said headstock support portion being subdivided into a gearbox portion, wherein said gearbox portion provides clearance and support for said first end of said drive shaft, a vacuum chamber, and pressurized air passageways;

a tailstock support portion, wherein said tailstock support portion supports a second end of said drive shaft, and wherein said tailstock support portion is subdivided into a mounting portion and a connecting portion, said connecting portion having a transverse interface surface for interconnection with said headstock support portion wherein said transverse interface surface and said headstock support portion have matching patterns of holes for alignment and connection of said connecting portion to said headstock support portion.

2. The modular base of claim 1 wherein each of said modules further includes side interface surfaces for mating with side interface surfaces of adjacent modules wherein said side interface surfaces of each of said modules making up said modular base have matching patterns of bolt holes and keyways for alignment and connection of said modules to each other in side-by-side relationship.

3. The modular base of claim 1 wherein said connecting portion of said tailstock support portion extends underneath and substantially parallel to said drive shaft; and wherein said connecting portion has a substantially triangular cross section in a plane perpendicular to said drive shaft, said triangular cross section having an apex, and said apex of said triangular cross section being the portion of said triangular cross section closest to said drive shaft.

4. A modular base for supporting can processing equipment wherein said modular base includes a plurality of modules; each module having at least two drive shafts with one of said drive shafts being a spindle drive shaft and carrying thereon tools for reshaping cans and can support pockets for supporting said cans during said reshaping; another of said drive shafts being a transfer drive shaft mounted parallel to said spindle drive shaft and carrying thereon can transfer pockets for moving cans to and from said can support pockets; each of said modules further including a headstock support portion and a tailstock support portion; said headstock support portion supporting a first end of said spindle drive shaft and supporting driving means connected to said spindle drive shaft; said headstock support portion being subdivided into an upper gearbox portion for providing location and support of said first end of said spindle drive shaft along with said driving means connected to said spindle drive shaft, a vacuum chamber, and pressurized air passageways; said tailstock support portion supporting a second end of said spindle drive shaft; said tailstock support portion being subdivided into a mounting portion and a connecting portion; said headstock support portion and said tailstock support portion each having axially spaced transverse interfacing portions with said transverse interfacing portions having matching patterns of holes for alignment and connection of said headstock support portion and said tailstock support portion to each other.

5. The modular base of claim 4 wherein said connecting portion of said tailstock support portion extends underneath said spindle drive shaft and substantially parallel to said spindle drive shaft; and wherein said connecting portion has a substantially triangular cross section in a plane perpendicular to said spindle drive shaft, said triangular cross section having an apex, and said apex of said triangular cross section being the portion of said triangular cross section closest to said spindle drive shaft.

6. A modular device for processing containers, wherein said modular device comprises:

a plurality of modules;

each of said modules having a shaft support portion;

each of said modules having a first shaft rotatably supported by said shaft support portion;

each of said modules having a drive means for rotating said first shaft;

said drive means for rotating said first shaft being housed within an internal chamber defined within said shaft support portion such that interconnection of two of said modules results in direct connection between respective drive means of said two modules.

7. The modular device of claim 6, wherein said drive means comprises a gear.

8. The modular device of claim 6, wherein each of said modules includes an interface surface having an opening therethrough;

each of said modules having a second internal chamber, with second internal chambers of said two interconnected modules being in open communication with each other through said openings in said interface surfaces.

9. The modular device of claim 6 wherein each of said modules further includes a second shaft;

said second shafts being rotatably supported by said shaft support portions;

a first can support pocket being connected to each of said first shafts;

a second can support pocket being connected to each of said second shafts in side-by-side relationship to a first can support pocket such that rotation of said first and second shafts results in a transfer of a can from a first can support pocket to a second can support pocket;

said drive means for rotating said first shaft comprising first and second gears mounted within said internal chamber, with said first gear being connected to said first shaft and said second gear being connected to said second shaft; and interconnection of two of said modules resulting in direct meshing engagement between a first gear of one of said two modules and a second gear of the other of said two modules.

10. A modular base for supporting can processing equipment, wherein said modular base comprises:

a module, said module having a drive shaft, and said module having a drive shaft support portion for providing location and support of a first end of said drive shaft;

said drive shaft support portion being subdivided into a plurality of internal chambers;

a first internal chamber forming a gearbox, with said gearbox housing a gear connected to said first end of said drive shaft;

said drive shaft support portion having a side interface surface, with said side interface surface having a first opening therethrough into said gearbox for allowing direct meshing engagement of another gear outside of said gearbox with said gear connected to said first end of said drive shaft; and said side interface surface having a second opening therethrough into a second internal chamber forming an air passageway for supplying pressurized air or vacuum during processing of cans.

11. The modular base of claim 10, wherein a plurality of said modules are connected in side-by-side relationship and wherein a first and a second internal chamber of a first module are in direct open communication through said first and second openings with corresponding first and second internal chambers, respectively, of a second adjoining module.

12. The modular base of claim 10, wherein a plurality of said modules are connected in side-by-side relationship and wherein a first internal chamber of a first module is in direct open communication through said first opening with a first internal chamber of a second adjoining module, and wherein a second internal chamber of said first module is sealed from communication with a second internal chamber of said second adjoining module at a side interface surface.

13. A modular base for supporting can processing equipment, said modular base comprising:

a module;

said module having a first and a second rotatably mounted shaft;

said first shaft being connected to an axially aligned pair of tooling rams;

a first can support pocket being connected to said first shaft in position for holding a can to be processed by said pair of tooling rams;

a second can support pocket being connected to said second shaft, said second can support pocket being positioned in juxtaposed relationship to said first can support pocket such that rotation of said first and second shafts results in a transfer of a can from said first can support pocket to said second can support pocket;

said module having a shaft support portion for providing location and support of a first end of each of said first and second shafts;

said shaft support portion being subdivided into a plurality of internal chambers;

a first internal chamber forming a gearbox, with said gearbox housing a first gear connected to said first end of said first shaft and a second gear connected to said first end of said second shaft;

said shaft support portion of said module having an interface surface, with said interface surface having a first opening therethrough into said gearbox for allowing direct meshing engagement of another gear outside of said gearbox with one of said first and second gears; and said interface surface having a second opening therethrough into a second internal chamber forming an air passageway for supplying pressurized air or vacuum during processing of cans.

14. The modular base of claim 13, wherein a plurality of said modules are interconnected at said interface surfaces in juxtaposed relationship.

15. The modular base of claim 14, wherein said interface surfaces have integral means for aligning and interconnecting two adjoining modules.

16. The modular base of claim 15, wherein said second opening of one of said two adjoining modules is sealed closed at said interface surface.

17. The modular base of claim 15, wherein said second openings of said two adjoining modules are connected together forming an air passageway for allowing open communication between said second internal chambers.

18. A modular base for supporting can processing equipment, wherein said modular base comprises:

a plurality of modules;

each of said modules having a first and a second rotatably mounted shaft;

said first shafts each having a central axis and being connected to a first beveled can support pocket positioned radially outwardly from said central axis for holding a can to be processed with a central axis of the can skewed relative to said first shaft central axis;

a second can support pocket being connected at a position radially outwardly from a central axis of each of said second shafts with each of said second can support pockets being mounted in juxtaposed relationship to one of said first beveled can support pockets such that rotation of said first and second shafts results in a transfer of a can from said first beveled can support pocket to said second can support pocket;

each module having a shaft support portion for providing location and support of a first end of each of said first and second shafts;

said shaft support portion being subdivided into a plurality of internal chambers;

a first internal chamber forming a gearbox, with said gearbox housing a first gear connected to said first end of said first shaft and a second gear connected to said first end of said second shaft;

said shaft support portion of each of said modules having an interface surface, with said interface surface having a first opening therethrough into said gearbox for allowing direct meshing engagement of another gear outside of said gearbox with one of said first and second gears; and said interface surface having a second opening therethrough into a second internal chamber forming an air passageway for supplying pressurized air or vacuum during processing of cans.

* * * * *